US006127291A

United States Patent [19]

Coppage, Jr. et al.

[11] Patent Number: 6,127,291

[45] Date of Patent: Oct. 3, 2000

[54] ANTI-BALLISTIC PROTECTIVE COMPOSITE FABRIC

[76] Inventors: Edward A. Coppage, Jr., 3031 Borge St. #109, Oakton, Va. 22124; Richard W. Coppage, 14607 Batavia Dr., Centerville, Va. 22020

[21] Appl. No.: 09/172,133

[22] Filed: Oct. 14, 1998

Related U.S. Application Data

[60] Provisional application No. 60/062,491, Oct. 20, 1997.

[51] Int. Cl.[7] ..... F41H 1/02

[52] U.S. Cl. ..... 442/135; 428/911; 442/134; 2/2.5; 89/36.05; 89/36.02

[58] Field of Search ..... 428/911; 442/135, 442/134; 2/2.5; 89/36.05, 36.02

[56] References Cited

U.S. PATENT DOCUMENTS

| | | | |
|---|---|---|---|
| 4,522,871 | 6/1985 | Armellino, Jr. et al. . | |
| 4,681,792 | 7/1987 | Harpell et al. | 428/102 |
| 4,737,402 | 4/1988 | Harpell et al. . | |
| 4,953,234 | 9/1990 | Li et al. | 428/911 X |
| 5,185,195 | 2/1993 | Harpell et al. . | |
| 5,190,802 | 3/1993 | Pilato | 428/911 X |
| 5,343,796 | 9/1994 | Cordova et al. . | |
| 5,395,671 | 3/1995 | Coppage, Jr. et al. . | |
| 5,536,553 | 7/1996 | Coppage, jr. et al. | 428/911 X |
| 5,660,913 | 8/1997 | Coppage, Jr. | 428/911 X |
| 5,851,932 | 12/1998 | Dickson et al. | 442/135 |

*Primary Examiner*—Daniel Zirker
*Attorney, Agent, or Firm*—Lowe Hauptman Gopstein Gilman & Berner, LLP

[57] ABSTRACT

A composite woven fabric made up of at least two plies of individual woven fabrics bonded together by a layer of flexible bonding resin disposed on juxtaposed surfaces of the individual woven fabrics. The bonding agent covers at least about 75%, preferably 100%, of the juxtaposed individual fabric surfaces and does not exude through the interstices of the woven fabric. The thus constituted fabric material is very good for use in making an anti-ballistic composite fabric. An anti-ballistic composite fabric is made up of at least one of these bonded woven fabrics sub-composites, preferably in combination with conventional non-woven fabric layers. This composite product has an exceptionally low areal density but still can withstand the impact of a 44 magnum projectile. It also offers excellent protection against knife and ice pick threats. One attribute of this composite fabric is its ability to reduce the trauma conventionally caused by the impact of a ballistic projectile, even though the projectile is stopped from penetrating the fabric.

30 Claims, No Drawings

ANTI-BALLISTIC PROTECTIVE COMPOSITE FABRIC

This application is a continuation in part of provisional application Serial No. 60/062,491, filed Oct. 20, 1997, the entire contents of which is incorporated herein by reference.

This invention relates to a novel composite fabric for use in protecting objects, notably the human body, against the penetration there into of incoming high energy, ballistic projectiles, knives and ice picks or other sharp instruments. This is commonly referred to as body armor, or more colloquially, a bullet-proof vest. This invention more particularly refers to a novel, very lightweight, composite fabric that will offer protection which satisfies the NJJ IIIA test against a 0.44 magnum, projectile as well as against lesser threats, such as 9 mm projectiles, at even lower areal densities than have been achievable in the past. Importantly, this invention also provides a fabric that offers protection against the penetration of sharp, non-ballistic, instruments, such as a knife or an ice pick, there through

BACKGROUND OF THE INVENTION

Body armor has been around for a long time. In general, the desire is to make the body armor as flexible, light and as breathable as possible and still withstand the impact of incoming projectiles or other lethal instrumentalities. In recent years, some body armor has been made from a woven and/or a non-woven fabric comprising filaments of very high molecular weight polymers, suitably polyolefins, such as polyethylene or high molecular weight polypropylene, and/or aramid polymers. These fabrics are sold commercially under the names "Spectra", "Protera" and "Kevlar". One of the newer anti-ballistic filaments is sold under the trade name "Zylon", which comprises a PBO resin.

It is also known in this art to create an antiballistic fabric by coating a woven layer of anti-ballistic cloth, such as an aramid (Kevlar), with a resorcinol-formaldehyde latex in a quantity sufficient to fill the interstices of the woven cloth and to coat the individual filaments/yarns of the woven fabric. This product is very stiff and brittle. Because the interstices are completely filled this fabric does not breath to any appreciable extent. Reference is here made to U.S. Pat. No. 4,522,871.

Reference is here made to U.S. Pat. No. 4,737,402 in the name of Harpell et al. which has an excellent discussion of the chemical nature of some of these filaments that have been found to be well suited to use in protective fabrics of the general type to which this invention is directed. The entire substance of this patent is incorporated herein by reference. The object of these composite fabrics is to cause the incoming ballistic projectile to expend its energy breaking the filaments of the fabric, and therefore to lose its energy and its impetus to penetrate into the body being protected by the fabric. It has previously been found that composite fabrics made up of woven fabrics and non-woven disposed in layers have a better combination of stopping power and light weight than do fabrics made of the same material in either woven or non-woven form in a non-layered assembly for the same weight of fibers.

It had recently been found, see U.S. Pat. No. 5,395,671, the entire substance of which is incorporated herein by reference, that a certain construction of a composite fabric, comprising multi-layers of high molecular weight woven and non-woven fabrics, respectively assembled in a particular manner, had unusual ability to stop the penetration of even very high energy projectiles, such as a very high energy projectile issuing from a 0.44 magnum bullet. This composite fabric construction also has the ability to stop a projectile from a 9 mm bullet. This composite fabric comprised at least two independent layers of material.

In this composite fabric, the two layers of material, each composed of a plurality of sub-layers, were not attached to each other. The "incoming" side of the fabric, that is the side of the composite fabric that is facing in the direction from which the projectile threat is incoming, is suitably made of multiple sub-layers or plies of non-woven fabric, comprising very high molecular weight polymer filaments that are usually individually disposed unidirectionally. The structure of the sub-plies of the non-woven fabric is often a plurality of layers of such unidirectionally disposed fibers, with successive layers assembled crosswise to each other. Thus, the unidirection of the filaments or fibers of these multiple layers can be considered to be disposed at angles to each other. For example, if the direction of the fibers of the first layer are considered to be at an angle of 0°, the fibers of the next layer might be considered to be disposed at an angle of 90° with respect to direction of the first filaments. In the next layer, the filaments might be laid substantially parallel to the filaments of the first layer and would thus have a 0° orientation, and so forth. Of course, other sequences of filament angular displacements are appropriate as well, such as for example 45° angular displacements. Thus a series of four (4) successive layers might be angularly offset as follows: 0°, 45°, 90°, 45°, and then back to 0°, whereupon the series pattern starts again. The layers could also be angularly offset by increments of 30° to make up a five (5) layer repeating pattern.

The "skin" side of the fabric, that is the side of the fabric disposed away from the incoming direction of the projectile, and disposed toward the object in need of protection, is suitably made up of multiple sub-plies of woven fabric comprising high molecular weight polymer filaments woven together in any chosen weave pattern. These woven filaments, or threads, can have substantially the same chemical composition as the filaments that make up the non-woven layers. It is also possible for the woven and the non-woven filaments of a given composite fabric to be made of different polymers. The specific filaments of either the woven or the non-woven sub-plies, or both may be made of mixed filaments, that is filaments of different chemical composition and/or different molecular weights and/or different denier and/or different filament cross section configuration. It is also possible to reverse the woven fabric and place it on the incoming side, with the non-woven fabric being, disposed on the skin side.

In one, known, particularly good construction of body armor, the sub-layers or plies of the woven fabric are quilted together. It has been found that a composite fabric with an excellent combination of projectile stopping power, flexibility and light weight has been achieved with a combination of a woven fabric side and a non-woven fabric side, where two criteria hold true. A plurality of the woven sub-plies are quilted together and form the skin side of the fabric, and a plurality of sub-criteria of the invention of the above referred to '671 patent because it is the combination of these two elements that has been found to cause the final composite fabric to have its unusual and unexpectedly effective stopping power coupled with unusual light weight.

Another recent development in this field is disclosed in U.S. Pat. No. 5,343,796. This patent describes a composite fabric protective system comprising an incoming, or face, layer that has as its purpose to slow the velocity and reduce the energy of the incoming projectile so that the second, skin layer, then can stop this now lower velocity/lower energy projectile. According to this patent, the first, or incoming layer (referred to in the patent as the "face layer" is a pliable, cut resistant fibrous layer; and the second, or "skin layer" is a pliable impact/ballistic energy absorbing fibrous layer. The '796 patent also alleges that the first and second layers can be reversed with the energy absorbing layer being the face layer and the cut resistant layer being the second layer. Three layer sandwich composite fabric systems are also disclosed where the third layer is like the first layer.

Many different fibers and fiber combinations are disclosed in this reference and the entirety of this reference is therefore incorporated herein by reference. Any of these fibers and fiber combinations, as well as other fibers and fiber combinations can be used in the practice of the instant invention.

The composite fabric of the '671 patent is an excellent protective material from which excellent protective garments are made. However, because this composite fabric was intended to stop a 240 grain 44 magnum bullet traveling at an impact velocity of 1450 feet per second, the fabric is necessarily fairly heavy. That is, it has a higher than desired areal density. It is made up many layers of both woven and non-woven sub-layers that have been assembled as aforesaid. Because this fabric has to have this exceptional stopping power, it is necessarily made up of these multiple layers of woven and non-woven fabrics. The intended use of this fabric, that is to stop a 0.44 magnum projectile, requires that there be a substantial number of sub-layers of non-woven fabric in this composite. The use of such multiple layers of non-woven fabrics, made of high molecular weight polymer filaments, makes the fabric reasonably stiff and therefore less than ultimately comfortable to the wearer. Further, the lowest areal density that has been achieved with this composite fabric configuration while retaining the ability to stop a 0.44 magnum projectile, traveling at an impact velocity of 1,450 feet per second, has been about 0.95 to 1.15 pounds per square foot.

The need for serious impact protection was answered by the fabric of the '671 patent, but at these very low areal densities, protection was afforded only for lower energy projectiles. This special fabric structure could be assembled at the set forth low areal density range that was considered to be quite low at the time.

Stiff protective clothing, particularly such clothing that has a very tight weave or disposition of filaments, and even more particularly such clothing that comprises layers of non-woven fabric, has a degree of discomfort to the wearer in direct proportion to its areal density and its flexibility. For the same polymer filaments, it is axiomatic that the higher the areal density of the fabric, the greater is the stopping power of the fabric. In higher areal density fabrics, there are more filaments in the way of the incoming projectile. It is also a fact that, for fabrics made up of the same filaments, the higher the areal density of a fabric, the stiffer is the fabric because it has more filaments and therefore progressively fewer void spaces. Similarly, the tighter the weave of the fabric, or the closer together are the filaments of the non-woven fabric, the higher will be the areal density and the stiffer will be the fabric.

In modern protective clothing, a balance must be struck between the stopping power of the anti-ballistic portion of the garment or fabric and the degree of discomfort the wearer is willing to put up with. If the fabric has too few filaments, or if the molecular weight and/or denier of the filaments making up the fabric is too low, or if the fabric is too thin, even though the fabric will have greater wearability, there will be insufficient ballistic protection afforded the wearer, and the fabric will not have achieved its purpose.

The direction in which this art is going is consistent with the direction in which the power of guns is going. That is, with time, the impact velocity and penetrating power of ballistic projectiles has continued to increase, and therefore, the stopping power of protective garments has also increased. This has been accomplished by using stronger and higher molecular weight filaments, by increasing the weight and stiffness of the fabric, and by assembling the fabric from different elements and in different configurations, such as using both woven and non-woven fabrics, which provide different, and cumulatively superior effective kinds of stopping power. However, it is also desired to lighten the fabric, make it less uncomfortable to the wearer, and still have it stop high energy incoming ballistic projectiles, like that issuing from a 0.44 magnum bullet.

U.S. Pat. No. 5,185,195 discloses a penetration resistant article which is made up of plural layers of ballistic fabrics that have been stitched together in a certain pattern. The purpose of this construction is to stop knife and pick penetration. Specifically, this patent discloses joining together at least two plies of flexible fibrous materials. The key element of this patent is the stitching together of these two or more layers of flexible fabric such that the rows of stitches that are adjacent each other are separated by less than about ⅛ of an inch. In this disclosure, the stitching pattern is critical, and the proximity of the lines of stitching is an essential part of the invention disclosed therein as it is alleged that it is this stitching pattern that creates the knife and pick stopping power that is the reason for the composite fabric that has been disclosed. It is important to note that the securing means, the stitching or the like, is not disclosed to cover the substantial entirety of the fabric sub-layers that are being attached to each other. The distinctness of the several lines of securing of the two sub-layers of flexible fabric together is disclosed as being important to maintain the flexibility of the composite sub-fabric, and therefore the flexibility of the entire final fabric that is made up of a plurality of sub-assemblies of fabrics, some joined together and others not.

The product of the '195 patent is said to be useful in preventing the penetration of knife and pick attack. However, in practice, it has been found that the proximity of the stitching securing means does not accomplish the intended purpose. In fact, because of the tightness of the securing of the two sub-fabrics together, knife penetration is not substantially retarded at all. A sharp knife or pick penetrates this composite fabric almost as easily as it does fabrics of the same sub-fabric construction that have not been stitched together.

OBJECTS AND BRIEF DESCRIPTION OF THE INVENTION

It is therefore an object of this invention to provide a very lightweight, novel fabric structure that has level IIIA stopping power against a 0.44 magnum projectile incoming at a velocity of about 1,400 to 1,450 feet per second, but yet has a very low areal density and is therefore more comfortable to wear.

It is another object of this invention to provide a very lightweight, novel fabric structure that has stopping power against a 9 mm projectile under the conditions of the N.I.J. level IIIA test, but yet has, even lower areal density than has ever before been achieved, and is therefore more comfortable to wear.

It is a further object of this invention to provide a novel fabric that not only has excellent stopping power against incoming ballistic projectiles, but also has excellent stopping power against knife and pick (ice pick) threats.

Other and additional objects will become apparent from a consideration of this entire specification, including the claims appended hereto.

In accord with and fulfilling these objects, the composite protective fabric of this invention comprises a plurality of sub-layers of ballistic fabric of special construction that are arranged in one or more configurations that overall are consistent with the overall assembly structures that have been known in the prior art. Specifically, the composite protective fabric of this invention comprises a first, non-woven, outer face fabric layer, that can be referred to as the incoming side of the composite fabric; and a second, woven, inner fabric layer, that can be referred to as the skin side of the composite fabric of this invention. It is within the spirit and scope of this invention to reverse the woven and non-woven layers in the sense that the incoming layer could be the woven layer and the skin layer could be the non-woven layer. Further, the woven and non-woven sub-layers can be alternated in any pattern that may be desired. An arrangement where the non-woven fabric is the outer, or incoming, layer is preferred. In one embodiment, a sandwich construction is envisioned where the inner, skin, and outer, incoming, layers are both either woven or non-woven fabric and the middle layer is the other. Of course, more than three layers can be used. Where more than two layers of fabric are used, it is preferred that they alternate between woven and non-woven layers. According to this invention, any of the layers, woven or non-woven, can be made up of a plurality of sub-layers.

The non-woven fabric layer is suitably made up of one or a plurality of individual non-woven sub-plies. Each of these individual sub-plies is conventionally made up of unbonded, or resin bonded, substantially unidirectional non-woven ballistic fibers. A single sub-ply can be made up of a plurality of sheets of unidirectionally disposed filaments where each sheet is disposed at an angle with respect to the next adjacent sheet(s) of unidirectional filaments, in the same manner as aforesaid. This configuration of a non-woven sub-ply comprising plural rotated layers is not novel to this invention, but is per se known. If the sub-plies or sheets are resin bonded, it would be correct and accurate to refer to them as resin bonded non-woven filament sub-plies, or sheets. Alternatively, it would also be correct to refer to these several sub-plies or sheets of resin bonded non-woven fabric as resin reinforced by one or more sheets of substantially unidirectional ballistic fiber. There is no limit to the number of sub-plies of non-woven fabric that can be used in making the composite fabric of this invention. The more sub-plies of fabric that are used, the greater will be the stopping power, but also the greater will be the stiffness of the resultant fabric. Therefore, it is best to strike a balance between stopping power and wearability.

Suitably, it has been found that composite fabrics comprising between about 4 and 20 sub-plies of substantially unidirectional non-woven fabric, that may either be of resin bonded or unbonded, or may be a combination of resin bonded and unbonded filaments are suitable for use as this layer(s) of the composite fabric of this invention. As noted, a plurality of these layers are suitably used to make up the entire anti-ballistic composite fabric.

The woven fabric layers in prior art composite fabrics have been made up of a multiplicity of individual woven sub-plies of conventional ballistic fibers, filaments or yarns (sometimes collectively referred to hereinafter as filaments or yarns). These woven sub-plies are suitably woven in a pattern that utilizes about 25 to 75 filaments per inch in each direction. More or less filaments can be used and still be within the scope of this invention. The weaves of the woven sub-plies may be the same or different, and any weave, whether known or new, is acceptable for use in this aspect of this invention. Each woven sub-ply may have the same number of fibers in each direction or a different number of fibers in each direction. Different woven sub-plies may have different numbers of fibers in each or both directions. Different woven sub-plies may be made of the same or different polymer yarns or filaments, and different polymer filaments can be mixed in a single sub-ply. It has been found that sub-plies having a 45× 45 (filaments to the inch) weave, or a 56×56 weave are particularly useful in this invention provided that they are made up of certain chemical composition filaments. When the preferred PBO polymer yarns are used, the most preferred weave has about 31 yarns per inch in both directions.

In the prior art, composite fabrics have been disclosed that are made up of a plurality of woven yarn sub-plies on one side and a plurality of non-woven sub-plies on the other, with additional repeating layers of either woven or non-woven layers of sub-plies, or both, as needed to attain the protection desired while keeping the areal density as low as possible. In all cases in the prior art, however, even in those cases where the individual sub-plies of woven fabrics are calendared or quilted, the individual sub-plies of woven fabric have not heretofore been resin bonded together. The woven fabric portion of the composite fabrics of anti-ballistic clothing is the part of the composite fabric that contributes most to improvements in wearability of the composite fabric as a whole. This is the portion of the composite fabric that breathes. Compared to the non-woven portion of the composite fabric, the woven portion is softer and more like conventional, not anti-ballistic, fabric.

According to this invention substantial improvements in wearability and both resistance to penetration by ballistic projectiles, and by knife and pick threat, are achieved by resin bonding adjacent sub-plies of woven fabric together. It is to be understood that resin bonding sub-plies of woven fabric together, to make sub-sets of joined woven fabric sub-plies, may somewhat increase the stiffness of the final product, depending on how much bonding resin, and what specific bonding resin, is used. The amount of flexibility that is sacrificed by resin bonding at least some of the woven sub-plies together is more than made up for by a decrease in the areal density of the total fabric that is achieved.

Contrary to the result achieved by resin bonding together unidirectional layers of non-woven material to produce a product that is rather stiff and more difficult to bend, bonding together some of the woven fabric sub-plies has only a very minor reducing effect on the flexibility of the woven fabric sub-plies. This is particularly true where a flexible resin is used as the interlayer bonding agent. With the direction of the art being toward greater wearability, greater flexibility and lighter weight, it would be considered to be counter to the state of the art, and to the direction in which this art is progressing, to resin bond any of the sub-plies; especially the woven sub-plies. This would have been thought by the person of ordinary skill in the art to be counter productive, and a step backward in the art, because it would be seen as likely to cause a stiffening and weighting of the composite fabric.

It has now been found, according to this invention, that it is possible to improve the performance of an anti-ballistic, anti-knife/pick penetration composite fabric of the type that employs a combination of a plurality of woven fabric sub-plies, or a combination of woven and non-woven sub-plies, by resin bonding a small fraction of the woven sub-plies together. Thus, for example, if a conventional composite fabric configuration is an assembly of 10 woven sub-plies as one side of the final composite fabric, and some appropriate number of non-woven (resin bonded or not) sub-plies as the other side of the final composite fabric, and to thereby achieve a composite structure that has a certain areal density and a certain stopping power against a particular threat, that stopping power can be significantly improved, while maintaining or even reducing the fabric's areal density, by resin bonding together a limited number of sub-sets of woven sub-plies, for example bonding together one or more adjacent pairs of woven sub-plies. The chemical and physical nature of the bonding resin is a very important part of the instant invention and will be discussed further below. Suffice it to say here, the bonding resin must be one that does not ever set up into a stiff, substantially inflexible material.

In this configuration according to this invention, the exemplified 10 sub-plies of woven fabric might be converted into 5 sub-sets of bonded pairs of woven sub-plies. It has been discovered that for the same areal density, this novel configuration has significantly better stopping power. By making a composite fabric employing these sub-assemblies, or sub-sets, of resin bonded, woven fabrics, it has been possible to make a final composite fabric that passes the N.I.J. level IIIA specification in response, not only to a 9 mm projectile, which the prior art could achieve, but also to a 0.44 magnum projectile, and to do so at a remarkably low areal density of (about 0.75 to 0.95 pound per square foot. It has never before been possible to stop a 0.44 magnum projectile traveling at an impact velocity about 1,400 to 1,450 feet per second with a soft, flexible fabric material having an areal density of less than about 0.95 pounds per square foot. As a consequence, composite fabrics made according to this invention can satisfy the N.I.J. IIIA specification against a 9 mm projectile at an even lower areal density than with respect to a 0.44 magnum threat.

The individual woven sub-fabrics of the composite fabric, and indeed of the resin bonded sub-assemblies, of this invention can be calendared or not. A combination of some calendared and some uncalendared fabrics is also suited to use in this invention. As among the plurality of sub-plies of individual woven fabric, some of these sub-plies can be resin bonded together and some others can be calendared. Alternatively, some of the woven sub-plies can be both calendared and resin bonded while others can be either calendared or not. The woven fabric portion of the composite fabric of this invention can be made up of groups of sub-sets of sub-plies of woven ballistic fabric that are resin bonded together and other groups of sub-plies that are not. Among all of these woven sub-plies, some may be calendared and others not. Additionally, some or all of the woven sub-plies or resin bonded sub-assembly combinations of woven ballistic fabric may not be attached to each other.

Calendaring of the sub-plies of woven fabric causes the fabric of the ply to flatten out. It also causes the individual fibers of the filaments/yarns that make up the woven sub-ply, to spread out and partially cover the gaps (interstices) in the weave. This calendaring therefore causes the same number and weight of the same fibers of the woven yarns to actually cover a larger area. Put another way, calendaring of the woven sub-plies forces some portions of at least some of the fibers in the woven yarns into the interstitial spaces between the main filament or yarn bodies of the weave. This puts more fiber in the way of the incoming ballistic projectile or knife threat and gives the composite fabric greater stopping power while at the same time making it thinner and more flexible. It also makes for smaller weave interstices while not substantially changing the areal density of the whole composite fabric.

It will be clear that the areal density of an uncalendared woven fabric is about the same as the areal density of the calendared woven fabric because the amount of filamentary material per unit area is the same, only the filaments have been internally laterally spread out by the calendaring process. Thus, by calendaring several sub-plies of woven fabric, greater stopping power is achieved at the same areal density and, because the fabric is thinner, it has greater flexibility and wearability. Conversely, for the same stopping power, a composite fabric assembled according to this invention will have a lower areal density and at least the same flexibility.

It is possible to achieve similar results by using filaments that have non-circular cross sections as spun. Thus, by weaving filaments with an oval, elliptical, or other cross section, for example, and providing that the large diameter of the oval or elliptical cross section is generally parallel to the plane of the woven sub-fabric, more of the open interstices of the woven sub-plies will be covered and the resultant fabric will have greater stopping power for the same areal density. A combination of special cross section filaments and calendaring of the finished woven fabric will still further increase the stopping power of the composite fabric of this invention.

Care must be taken not to resin bond together too many of the woven fabric sub-plies, or to use too much bonding resin, else the resultant fabric may become too stiff even if the bonding resin is one that retains its flexibility upon cure. It has been found that it is desirable to resin bond the sub-fabric plies in groups of two (2) or three (3) or four (4). More individual woven fabrics bonded into sub-plies can be used, but no particular advantage has been found in doing so. In some embodiments of this invention, it is desirable to resin bond together at least about half the sub-plies of woven fabric to produce a product with all of its woven fabric sub-plies in sub-assemblies of woven sub-plies. In another embodiment of this invention, where the threat is not as severe, up to about half of the woven fabrics can be assembled into bonded pairs, or triples or quads of woven fabrics. This will then produce a final composite fabric with up to about ¾ as many woven fabric structures as there were original un-assembled sub-plies of woven fabric layer(s). One preferred arrangement is to resin bond together every other pair of woven sub-plies. This configuration gives good added stopping power without sacrificing too much flexibility and maintaining the same or even lower areal density as the unbonded composite fabric had. Another preferred arrangement is to resin bond together every pair of woven fabrics. This substantially increases the stopping power of the product, while maintaining a very similar, but somewhat higher, areal density.

It is desirable to minimize the amount of bonding resin that is used in this invention while at the same time substantially covering at least about 75%, preferably all, of the surface of the fabrics being bonded together. Suitably, where two woven sub-fabrics are being resin bonded together into a sub-set, the bonding resin comprises about 5 to 30% of the fiber weight of total of the two (2) sub-plies that are being bonded together. In a two ply bonded system, the bonding resin is applied to one side of one of the plies and the other ply is overlayed on top of this resin bearing side. The assembly can be allowed to bond under its own weight, or pressure can be applied. The bonding resin will inherently impregnate the interstices of the woven fabric sub-plies as a consequence of the flowability of the bonding resin during its set up period. Care should be taken that not too much resin is applied, and not so much pressure is exerted on the assembled set of woven fabric sub-plies that bonding resin exudes out the opposite surface of the sub-plies whereupon the next adjacent layer of woven sub-ply might become unintentionally bonded to the resin bonded assembled pair of woven sub-plies. It is considered to be preferred within the scope of this invention to bond the woven fabric sub-plies together with a complete coating of bonding resin, or in the alternative to spot bond sub-plies of woven fabric together. According to this invention, some of the sub-plies of woven fabric may be spot bonded together and others may be full coating bonded together. Where spot bonding is used, at least about 75%, and preferably at least about 90%, of the surface of each of the woven sub-plies being bonded together should be covered with bonding resin. The thickness of the bonding resin applied to the surface of the woven fabrics being bonded should be substantially less than the thickness of the fabrics themselves. The conditions of bonding should be such as to discourage penetration of the bonding resin entirely, or even substantially through the interstices of either of the woven fabrics that are being bonded together.

If three woven fabric sub-plies are being bonded together, the bonding resin will usually comprise a larger proportion of the weight of the total bonded assembly. In a bonded assembly of three woven sub-plies, a suitable proportion of bonding agent would be about 10 to 50% of the total fiber weight. Similarly increased relative proportions of resin to total sub-assembly weight would apply to an assembly of four or more sub-plies of woven fabric.

It is important that a balance be struck between the added stopping power achieved by resin bonding a given number of sub-plies of woven fabrics together and the small loss in flexibility that is caused by the assembly of woven sub-plies into bonded sub-assemblies. It has been found that each successive pair of woven sub-plies can be bonded together, or that each successive three sub-plies can be resin bonded together, or that even each successive four plies of woven fabric can be bonded together, so that in effect, all of the woven sub-plies are assembled into a reduced number of resin bonded sub-assemblies. Usually at least about ten percent of the woven fabric sub-plies are assembled into sub-sets of two (2) or more woven sub-plies. However, it is preferred that the number of woven fabric sub-plies that are assembled into any one sub-set be not more than about 20 percent of the total number of available woven fabric sub-plies. Preferably the resultant number of resin bonded assembled sub-sets will include all of the woven fabric sub-plies and the resultant number of sub-set assemblies will be about one third to two thirds of the number of original sub-plies of woven fabric. It is preferred that the number of resultant sub-assemblies of resin bonded woven sub-plies will be about half the number of original sub-plies.

It has been found that, if the composite fabric of this invention is assembled with a plurality of non-woven fabric sub-plies making up the incoming side, and a plurality of resin bonded sub-sets of assembled woven fabric sub-assemblies making up the skin side, not only is the stopping power of the composite fabric substantially, and unexpectedly, improved, but the impact induced deformation of the composite fabric is substantially reduced. When the composite fabric of this invention, or of prior art composite or other fabrics, stops an incoming projectile, trauma is still caused, despite the bullet being stopped from penetrating the protected body because, at the same time as the bullet is stopped, the composite fabric is so deformed by the impact of the bullet that the protected body may be seriously injured anyway by the impact of the deformation of the composite fabric. This is substantially prevented, or at least substantially reduced, by the special configuration of the composite fabric of this invention, even when stopping the penetration of a high energy 0.44 magnum bullet.

DETAILED DESCRIPTION OF THIS INVENTION

According to this invention, the instant composite fabric comprises at least one group of sub-assemblies of woven fabric plies. The composite fabric of this invention may be made up entirely of such plural sub-assemblies of woven fabric plies. In a preferred embodiment of this invention, however, the instant invented product is made up of a composite of at least one set of such assembled bonded woven fabric sub-plies and at least one set of a plurality of sub-plies of non-woven fabrics. Each non-woven fabric sub-ply comprises a multiplicity of filaments or yarns of high molecular weight polymers, such as for non-limiting example, polyolefins, such as polyethylene or polypropylene; aramids; PBO's, polyvinyl alcohol or other suitable polymers that are per se well known in this art. The use of other polymers is also within the scope of this invention.

Each non-woven fiber sub-ply can be made of a single sheet of non-woven filaments, suitably unidirectional aligned filaments, or a plurality of sheets of such filaments. The non-woven sub-plies may be resin impregnated or not. Where there are multiple sheets of non-woven fabrics, each sheet of unidirectional filaments can be angularly disposed relative to its adjacent sheets. The filaments of these non-woven sheets or plies do not have to be unidirectional in alignment, but could be randomly disposed. Unidirectional alignment has been found to give better stopping power, particularly when successive layers are angularly offset from each other. However, this invention is not limited to these non-woven sub-plies being composed of unidirectionally laid filaments. The sub-plies of non-woven fabric, or some of them, can be, but do not have to be, resin bonded together. These individual resin bonded sub-plies are generally stiffer than the woven sub-plies. Therefore, it is preferred to assemble the non-woven plies in a loose "pile" rather than bonding them together.

It is considered to be within the scope of this invention to resin bond together some sub-plies of non-woven fabric and not others. Similarly, some of the sheets of non-woven fabric may be resin bonded together, and other sheets not so bonded.

The other group of sub-plies of fabrics, preferably the group that is directed toward the object being protected, that is the skin side of the composite fabric, is made up of a plurality of woven fabric sub-plies, wherein at least some, and in some cases all, of these woven sub-plies are lightly resin bonded together into sub-assemblies of bonded groups of woven fabrics. The assembly of these sub-assemblies, or sub-sets, of resin bonded sub-plies of woven fabrics can be loosely accumulated without actually joining them together, or they can be held together such as by being quilted together, either by stitching/sewing or by chemical (resin) spot bonding, or they can be bar tacked together. They can be tacked together about their peripheryal edges, or at least some of these edges. They can also be joined in other areas as is per se known. It is preferred that these sub-assemblies of woven resin bonded woven fabrics not be joined together in their central portions. These joining elements may be in a patterns or they may be random.

Illustrative of useful the organic fibers, that make up the yarns/filaments of the woven sub-plies can be substantially any ballistic fiber, preferably high molecular weight, are those composed of polyesters, polyolefins, polyetheramides, fluoropolymers, polyethers, celluloses, phenolics, polyesteramides, polyurethanes, epoxies, aminoplastics, polysulfones, polyetherketones, polyetherether-ketones, polyesterimides, polyphenylene sulfides, polyphenylene oxides, polyether acryl ketones, poly(amideimides), and polyimides. Illustrative of other useful organic filaments are those composed of aramids (aromatic polyamides), such as poly(m-xylylene adipamide), poly(p-xylylene sebacamide) poly(2,2,2-trimethyl-hexamethylene terephthalamide) (Kevlar); aliphatic and cycloaliphatic polyamides, such as the copolyamide of 30% hexamethylene diammonium isophthalate and 70% hexamethylene diammonium adipate, the copolymide of up to 30% bis-(amidocyclohexyl) methylene, terephthalic acid and caprolactam, polyhexamethylene adipamide (nylon 66), poly(butyrolactam) (nylon 4), poly (9-aminononanoic acid) (nylon 9), poly (enantholactam) (nylon 7), poly(caprylactam) (nylon 8), polycaprolactam (nylon 6), poly (p-phenylene terephthalamide), polyhexamethylene sebacimide (nylon 6,10), polyaminoundecanoamide (nylon 11), polydodecanolactam (nylon 12), polyhexamethylene isophthalamide, polyhexamethylene terephthalamide, polycaproamide, poly (nonamethylene azelamide), (nylon 9,9), poly (decamethylene azelamide) (nylon 10,9), poly (decamethylene sebacamide) (nylon 10,10), poly[bis-(4-aminocyclohexyl) methane 1,10-decanedicarboxamide] (Qiana), or combination thereof; and aliphatic, cycloaliphatic and aromatic polyesters such as poly(1,4-cyclohexylidene dimethyl eneterephthalate) cis and trans, poly(ethylene-1,5-naphthalate), poly(ethylene-2,6-naphthalate), poly(1,4-cyclohexane dimethylene terephthalate) trans, poly(decamethylene terephthalate), poly(ethylene terephthalate), poly(ethylene isophthalate), poly(ethylene oxybenzoate), poly(para-hydroxy benzoate), poly(dimethylpropiolactone), poly(decamethylene adipate), poly(ethylene succinate), poly(ethylene azelate), poly (decamethylene sebacate), poly(dimethylpropiolactone) and the like.

Also illustrative of useful organic filaments are those of liquid crystalline polymers such as lyotropic liquid crystalline polymers which include polypeptides such as poly(γ-benzyl L-glutamate) and the like; aromatic polyamides such as poly(1,4-benzamide), poly(chloro-1,4-phenylene terephthalamide), poly(1,4-phenylene fumaramide), poly (chloro-1,4-phenylene fumaramide), poly(4,4'-benzanilide trans, trans-muconamide), poly(1,4-phenylene mesaconamide), poly(1,4-phenylene) (trans-1,4-cyclohexylene amide), poly(chloro-1,4phenylene 2.5-pyridine amide), poly(3,3'-dimethyl-4,4'-biphenylene 2.5 pyridine amide), poly (1,4-phenylene 4,4'-stilbene amide), poly(chloro-1,4-phenylene 4,4'-stilbene amide), poly(1,4-phenylene 4,4'-azobenzene amide), (4,4'-azobenzene amide), poly(4,4-azobenzene 4,4'-azobenzene amide), poly (1,4'-cyclohexylene 4,4'-azobenzene amide), poly(4,4'-azobenzene terephthal amide), poly(3, 8-phenanthridinone terephthalamide), poly(4,4'-biphenylene terephthalamide), poly(4,4'-biphenylene 4,4'-bibenzamide), poly(1,4-phenylene 4,4'-bibenzamide), poly(1,4'-phenylene 4,4'-terephenylene amide), poly (1,4-phenylene 2,6-naphthamide), poly(1,5-naphthylene terephthalamide), poly (3,3'-dimethyl-4,4'-biphenylene terephthalamide), poly(3,3'-dimethoxy-4,4'-biphenylene terephthalamide), poly(3,3'-dimethoxy-4,4'-biphenylene-bibenzamide) and the like, polyoxamides such as those derived from 2,2' dimethyl 4,4' diamino biphenyl and chloro-1,4-phenylene diamine; polyhydrazides such as poly chloroterephthalic hydrazide, 2,5-pyridine dicarboxylic acid hydrazide) poly(terephthalic hydrazide), poly(terephthalic-chloroterephthalic hydrazide) and the like; polyamide-hydrazides such as poly (terephthaloyl 1,4 amino-benzhydrazide) and those prepared from 4-aminobenzhydrazide, oxalic dihydrazide, terephthalic dihydrazide and para-aromatic diacid chlorides; polyesters such as those of the compositions include poly [oxytrans-1,4-cyclohexylenecarbonyltrans-1,4phenyleneoxyterephthaloyl) poly[oxy-trans-1,4-cyclohexylenecarbonyl-β-oxy-(2-methyl-1,4-phenylene) oxyterephthaloyl],-o-cyclohexyleneoxycarbonyl-trans-1,4-cyclohexylene carbonyl-β-oxy(2-methyl-1,3-phenylene)-oxy-terephthaloyl] and the like; polyazomethines such as those prepared from 4,4'-diaminobenzanilide and terephthalaldehide, methyl-1,4phenylenediamine and terephthalaldehyde and the like; polyisocyanides such as poly(phenyl ethyl isocyanide), poly(n-octylisocyanide) and the like; polyisocyanates such as poly(n-alkyl isocyanates) as for example poly(n-butyl isocyanate), poly(n-hexyl isocyanate) and the like; lyotropic crystalline polymers with heterocyclic units such as poly(1,4-phenylene-2,6-benzobisoxazole)-(PBO), poly(1,4-phenylene-1,3,4-oxadiazole), poly(1,4-phenylene-2,6-benzobisimidazole), poly[2,5,(6)-benzimidozole] (AB-PBI), poly[2,6(1,4-phneylene)-4-phenyl quinoline], poly[1,1'-biphenylene)-6,6'-bis(4-phenylquinoline)] and the like; polyorgano phosphazines such as polyphosphazine, polybisphenoxyphosphazine, polybis(2,2,2' trifluoroethylene) phosphazine and the like; Useful inorganic fibers include S-glass fibers, E-glass fibers, carbon fibers, boron fibers, alumina fibers, zirconia silica fibers, alumina-silicate fibers and the like; useful inorganic fibers include S-glass fibers, E-glass fibers, carbon fibers, boron fibers, alumina fibers, zirconia silica fibers, alumina-silicate fibers and the like; metal containing polymers such as those derived by condensation of trans-bis (tri-n-butylphosphine) platinum dichloride with a bisacetylene or trans-bis (tri-n-butylphosphine)bis(1,4-butadienyl) platinum, and similar combinations, in the presence of cuprous iodine and an amide; cellulose and cellulose derivatives such as esters of cellulose as for example cellulose triacetate, cellulose acetate, cellulose acetate-butyrate, cellulose nitrate, and cellulose sulfate; ethers of cellulose as for example, cellulose ethyl ether, cellulose hydroxymethyl ether, cellulose hydroxypropyl ether, carboxymethyl ether cellulose, ethyl hydroxyehyl ether cellulose, cyanoethyl ethyl ether cellulose, ether-esters of cellulose as for example acetoxy ethyl ether cellulose and benzoyloxy propyl ether cellulose, and urethane celluloses as for example phenyl urethane cellulose; thermotropic liquid crystalline polymers such as celluloses and their derivatives as for example hydroxypropyl cellulose, ethyl cellulose, propionoxy propyl cellulose; thermotropic copolyesters as for example copolymers of 6-hydroxy-2-naphthoic acid and p-hydroxy benzoic acid, copolymers of 6-hydroxy-2-naphthoic acid, terephthalic acid and p-amino phenol, copolymers of 6-hydroxy-2-naphthoic acid, terephthalic acid and hydroquinone, copolymers of 6-hydroxy-2-naphthoic acid, p-hydroxy benzoic acid, hydroquinone and terephthalic acid, copolymers of 2,6-naphthalene dicarboxylic acid, terephthalic acid, isophthalic acid and hydroquinone, copolymers of 2,6-naphthalene dicarboxylic acid and terephthalic acid, copolymers of p-hydroxybenzoic acid, terephthalic acid and 4,4'-dihydroxydiphenyl, copolymers of p-hydroxybenzoic acid, terephthalic acid, isophthalic acid and 4,4'-dihydroxydiphenyl, copolymers of p-hydroxybenzoic acid, isophthalic acid, hydroquinone and 4,4'-dihydroxybenzophenone, copolymers of phenylterephthalic acid and hydroquinone, copolymers of chlorohydroquinone, terephthalic acid and p-acetoxy cinnamic acid, copolymers of chlorohydroquinone, terephthalic acid and ethylene dioxy-4,4'-dibenzoic acid, copolymers of hydroquinone, methylhydroquinone, p-hydroxybenzoic acid and isophthalic acid, copolymers of (1-phenylethyl)hydroquinone, terephthalic acid and hydroquinone, and copolymers of poly(ethylene terephthalate) and p-hydroxybenzoic acid; thermotropic polyamides, and thermotropic copoly(amide-esters).

Also illustrative of useful organic filaments for use in the fabrication of fibrous layer 14 are those composed of extended chain polymers formed by polymerization of α,β-unsaturated monomers of the formula:

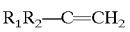

$$R_1R_2—C=CH_2$$

wherein:

$R_1$ and $R_2$ are the same or different and are hydrogen, hydroxy, halogen, alkylcarbonyl, carboxy, alkoxycarbonyl, heterocyclics or alkyls or aryls either unsubstituted or substituted with one or more substituents selected from the group consisting of alkoxy, cyano, hydroxy, alkyl and aryl. Illustrative of such polymers of α,β-unsaturated monomers are polymers including: polystyrene, polyethylene, polypropylene, poly(1-octadecene), polyisobutylene, poly (1-pentene), poly(2-methylstyrene), poly(4-methylstyrene), poly(1-hexene), poly(1-pentene), poly(4-methyloxystyrene, poly(5-methyl-1-hexene), poly(4-methylpentene), poly(1-butene), polyvinyl chloride, polybutylene, polyacrylonitrile, poly(4-methylpentene-1), polyvinyl alcohol, polyvinyl acetate, polyvinyl butyral, polyvinylidene chloride, vinyl chloride-vinyl acetate copolymer, polyvinylidene fluoride, polymethyl acrylate, polymethyl methacrylate, polymethacrylonitrile, polyacrylamide, polyvinyl fluoride, polyvinyl formal, poly (3-methyl-1-butene), poly(4-methyl1-pentene, poly(1-hexene), poly(5-methyl-1-hexene), poly(1-octadecene), polyvinyl cyclopentane, polyvinyl cyclohexane), poly(α-vinyl-naphthalene), polyvinyl methyl ether, polyvinyl ethyl ether, polyvinyl propyl ether), polyvinyl carbazole, polyvinyl pyrrolidone, poly(2-chlorostyrene), poly(4-chlorostyrene), polyvinyl formate, polyvinyl butyl ether, polyvinyl octyl ether, polyvinyl methyl ketone, polymethyl isopropenyl ketone), poly(4-phenylstyrene) and the like. In respect of the woven sub-plies, PBO's are the preferred polymers. In respect of the non-woven sub-plies, polyolefins are the preferred polymers.

It is essential that, whichever polymers are used to make the filaments or yarns from which the instant composite fabric is made, they must have a minimum tensile modulus of about 160 grams/denier and a tenacity of at least about 7 grams per denier. The fibers used in forming the woven fabric sub-plies of this invention preferably have a minimum tensile modulus of 300 grams per denier and a tenacity of at least 15 grams per denier.

Different filament materials have different inherent physical properties. Therefore, the minimum requirements are somewhat different minimum values for each fiber material that is used to make anti-ballistic fibers that are useful in this invention. These properties are generally known and have been previously reported. Specific reference is made to U.S. Pat. No. 4,681,792, that describes different polymer filaments that are useful in this invention. The entire contents of this patent are hereby incorporated herein by reference.

Where polyethylene filaments are used, they preferably have a minimum weight average molecular weight of 500,000, a minimum tensile modulus of 500 grams per denier, a tenacity of at least 15 grams per denier, and an energy to break of at least about 22 joules per gram. It is preferred to use polyethylene filaments having molecular weights of at least 1,000,000, and more preferably at least 2,000,000. Where polypropylene filaments are used, for example, their weight average molecular weight should be at least about 750,000, preferably between about 1 and 4 million, and most preferably between about 1.5 and 2.5 million. These fibers should have a modulus of at least about 300 grams per denier, a tenacity of at least about 8 grams per denier, and an energy to break of at least about 22 joules per gram. Exemplary polyvinyl alcohol filaments have similar minimum properties to those recited above for polyethylene. Polyacrylonitrile, nylon, polyethylene terephthalate, aramid and PBO polymers are also examples of polymers that are useful in this invention at minimum physical properties that are similar to those described above.

The woven sub-plies, and the resin bonded, or unbonded, non-woven sub-plies of substantially unidirectional fibers are per se known and have been widely used in the anti-ballistic, protective fabric technologies. This invention is directed to the special configuration of such generally known composite fabric construction, such as has been described above, where several sub-plies of the woven fabric portion of the composite fabric are bonded together with a non-rigid resin into sub-assemblies and these subassemblies used in place of the conventional individual woven sub-plies of fabric The resin used to bond the prewoven fabrics together suitably has a flex modulus of at least 6,000 psi, preferably at least 10,000 psi and has a rubbery consistency. One such suitable resin is a styrene-butadiene-styrene block copolymer. One example of such a resin, that is presently commercially available under the commercial designation D-1100, is made and sold by Shell Chemical Company. Reference is made to the Shell publication "Kraton Thermoplastic Rubber" SC-68-81. Many other flexible resins that never get rigidly hard even upon curing are also usable. The specific chemistry of the bonding resin is not critical to the practice of this invention. The physical properties of the resin are most critical. In this respect, as aforesaid, the resin must cure to a never hardening state and retain its flexibility upon cure and thereafter. The flexible resin must bond together adjacent layers of woven ballistic fabric without substantial penetration through the interstices of the fabric. The amount of flexible bonding resin is substantially more than would be used for spot bonding or for chemical quilting the woven fabric layers together. Examples of polymeric chemical reagents that are suitable for this use, in addition to the styrene-butadiene block copolymer mentioned above are: other block copolymers of conjugated dienes, such as butadiene, isoprene, and 4-methyl pentadiene, and vinyl aromatics such as styrene, methyl styrene, divinyl benzene, and t-butyl styrene; polybutadiene; polyisoprene; natural rubber; ethylene-propylene copolymers; ethylene-propylene-diene terpolymers; polysulfide polymers; polyuretheane elastomers, chlorosulfonated polyethylene; polychloroprene; plasticizedpolyvinyl chloride, butadiene-acrylonitrile elastomers; acrylonitrilebutadiene-styrene elastomers; isobutylene-isoprene copolymers; plasticized polyacrylates; polyesters, polyethers; fluorocarbon elastomers; and silicone elastomers;

In the most preferred embodiment of this invention, the composite fabric structure of this invention comprises at least one assembly of multiple sub-plies of non-woven fabric together with at least one assembly of multiple sub-plies of woven fabrics, where at least some of the woven fabric sub-plies are resin bonded together to make a plurality of resin bonded sub-assemblies of these woven fabric sub-plies. Most preferably, the woven fabric sub-plies comprise at least some, up to all, PBO filaments. The best stopping power, for the lowest areal density, has been achieved by using this assembly of woven sub-sets as the skin side and the assembly of non-woven sub-plies as the incoming side of the composite fabric.

The best V-50 against a projectile from a 9 mm bullet, under the conditions of the N.I.J IIIA 9 mm test, has been achieved with this specific structure and composition. Similarly, the lightest weight composite fabric ever to stop a projectile from a 0.44 magnum is this same fabric. Most importantly, as noted above, not only does this new composite fabric stop the high energy projectile from a 0.44 magnum, but it also substantially reduces deformation of the composite fabric. This deformation has in the past been caused by the impact of the projectile impacting on the fabric but not penetrating or passing through the composite fabric. The reduction of fabric deformation reduces trauma that has been conventionally inflicted on the protected body by the stopping of the incoming ballistic projectile.

This invention is also directed to the assembly of the composite fabric described above with a fabric or garment that does not itself offer protection against penetration by ballistic projectiles or knife or pick threats. This assembly may be in the form of inserts of the instant composite anti-ballistic fabric of this invention in judiciously located "pockets" of a preformed garment. It also may take the form of one or more layers of the composite fabric of this invention disposed adjacent to one or more layers of conventional (non-anti-ballistic) fabric, with this assembly formed into suitably shaped body armor. It also may take the form of sections of the composite fabric of this invention joined to sections of conventional fabric such as by stitching, and the thus joined material formed into a suitable garment.

One of the key elements of this invention is the resin that is used to join together the individual sub-plies of woven fabrics to make the unique sub-assemblies of this invention. This resin must be one that never sets up into a stiff plastic product. Suitable resins are those that retain their rubbery, flexible character throughout their life. The resins that are suited to use in this invention are of course liquid before they cure. They are applied to the surface of a woven fabric in a liquid condition of such viscosity that they do not tend to penetrate too deeply into the interstices of the woven fabric to which they have been applied. It is preferable that the curing conditions for the selected resins are such that the viscosity and the pressure obtained during curing do not cause the resin to penetrate through the interstices of the woven fabric to a substantially greater extent than is the penetration of the resin upon application and before curing.

A wide variety of elastomeric materials and formulations may be utilized in this invention. Representative examples of suitable elastomers have their structures, properties, formulations together with crosslinking procedures summarized in the Encyclopedia of Polymer Science, Volume 5 in the section Elastomers-Synthetic (John Wiley & Sons Inc., 1964). The essential requirement is that the matrix materials of this invention have appropriately low moduli. For example, any of the following materials may be employed: polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinychloride using dioctyl phthate or other plasticers well known in the art, butadiene acrylonitrile elastomers, poly(isobutylene-co-isoprene), polyacrylates, polyesters, polyethers, fluoroelastomers, silicone elastomers, thermoplastic elastomers, copolymers of ethylene.

Particularly useful are block copolymers of conjugated dienes and vinyl aromatic monomers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multiblock copolymers of the type $(AB)_n$ (n=2–10) or radial $(BA)_x$(x=3–150); wherein A is a block from a polyvinyl aromatic monomer and B is a block from a conjugated diene elastomer. Many of these polymers are produced commercially by the Shell Chemical Co. and described in the bulletin "Kraton Thermoplastic Rubber", SC-68-81.

These low modulus elastomers may be compounded with fillers such as carbon black, silica, etc. and may be extended with oils and vulcanized by sulfur, peroxide, metal oxide, or radiation cure systems using methods well known to rubber technologists. Blends of different elastomeric materials may be used together or one or more elastomer materials may be blended with one or more thermoplastics. High density, low density, and linear low density polyethylene may be crosslinked to obtain a matrix material of appropriate properties, either alone or as blends.

What is claimed is:

1. In a composite anti-ballistic fabric comprising a plurality of individual plies of woven fabrics comprising anti-ballistic fibers;

the improvement that comprises:

at least one flexible, rubbery resin bonded, composite sub-assembly comprising at least two individual woven fabric plies bonded together by a surface layer of a substantially flexible rubbery resin that covers at least 75% of the juxtaposed surfaces of said at least two individual woven fabric plies to form said at least one sub-assembly, wherein said rubbery bonding resin does not penetrate through said woven plies, wherein said composite fabric comprises a plurality of said resin bonded sub-assemblies, and wherein said composite fabric has the ability to pass the NIJ IIIA specification in response to a 0.44 magnum projectile incoming at a velocity of about 1,400 to 1,450 feet per second.

2. An improved composite fabric as claimed in claim 1 wherein at least some of said sub-assemblies consist essentially of two resin bonded woven fabrics.

3. An improved composite fabric as claimed in claim 1 wherein said composite fabric comprises a plurality of said sub-assemblies.

4. An improved composite fabric as claimed in claim 1 wherein said composite fabric consists essentially of a plurality of said resin bonded two woven fabric sub-assemblies.

5. An improved composite fabric as claimed in claim 1 wherein said resin covers substantially all of the juxtaposed surfaces of said bonded woven fabrics.

6. An improved composite fabric as claimed in claim 2 wherein said composite fabric comprises a plurality of said sub-assemblies.

7. An improved composite fabric as claimed in claim 1 wherein said fibers of said individual woven fabrics comprise at least one polymer selected from the group consisting of a high molecular weight polyolefin, an aramid polymer, a polyvinyl alcohol polymer, and a PBO polymer.

8. An improved composite fabric as claimed in claim 1 wherein said individual woven fabrics of said sub-assembly are not joined together by quilting.

9. An improved composite fabric as claimed in claim 1 comprising a plurality of said sub-assemblies and wherein said sub-assemblies are not joined together by quilting.

10. An improved composite fabric as claimed in claim 1 wherein at least some of said sub-assemblies comprise more than two individual woven fabrics bonded together by said flexible resin that is disposed over at least about 75% of juxtaposed surfaces of all adjacent individual fabrics.

11. An improved composite fabric as claimed in claim 1 wherein said bonding resin is at least member selected from the group consisting of styrene-butadiene block copolymers; polybutadiene; polyisoprene; natural rubber; ethylene-propylene copolymers; ethylene-propylene-diene terpolymers; polysulfide polymers; polyuretheane elastomers, chlorosulfonated polyethylene; polychloroprene; plasticizedpolyvinyl chloride, butadiene-acrylonitrile elastomers; acrylonitrile-butadiene-styrene elastomers; isobutylene-isoprene copolymers; plasticized polyacrylates; polyesters, polyethers; fluorocarbon elastomers; and silicone elastomers.

12. An improved composite fabric claimed in claim 1 further comprising at least one ply of non-woven fibers.

13. An improved composite fabric as claimed in claim 1 wherein said plies bonded into said composite sub-assembly are exclusively bonded together by said flexible bonding resin disposed on said juxtaposed major surfaces.

14. In a composite anti-ballistic fabric comprising a plurality of individual plies of woven fabrics comprising anti-ballistic fibers;

the improvement that comprises:

at least one flexible, rubbery resin bonded, composite sub-assembly comprising more than two individual woven fabric plies bonded together by a surface layer of a substantially flexible, rubbery resin;

wherein said rubbery resin covers at least 75% of juxtaposed surfaces of each adjacent pair of individual woven fabric plies to form said at least one sub-assembly, wherein said rubbery bonding resin does not penetrate through said woven plies, wherein said composite fabric comprises a plurality of said resin bonded sub-assemblies, and wherein said composite fabric has the ability to pass the NIJ IIIA specification in response to a 0.44 magnum projectile incoming at a velocity of about 1,400 to 1,450 feet per second.

15. An anti-ballistic composite fabric comprising at least one layer of non-woven fibers bonded together by a bonding resin and at least one layer of the bonded woven fabric sub-assembly claimed in claim 1.

16. A method of protecting a body against penetration thereinto of an incoming ballistic projectile comprising:

applying a substantially permanently flexible, rubbery bonding resin in fluid, uncured, form to at least about 75% of a major surface of a first woven fabric, comprising anti-ballistic filaments;

disposing at least about 75% of a major surface of a second woven fabric, comprising anti-ballistic filaments, into contact with said uncured bonding resin;

compressing said assembly of said two woven fabrics and said flexible, rubbery bonding resin an amount sufficient to cause said bonding agent to adhere to surface fibers of said fabrics, but insufficient to cause said bonding resin to penetrate through said fabrics;

curing said flexible bonding agent under such conditions that the cured bonding agent adheres to and bonds together said juxtaposed major surfaces of said first and second woven fabrics to form a surface bonded, flexible, composite sub-assembly fabric, wherein said composite fabric maintains its substantial flexibility after curing said bonding agent;

forming a final composite fabric, comprising a plurality of said composite sub-assembly fabrics, having an areal density of less than about 0.95 pound per square foot and being able to pass an NIJ IIIA specification in response to a 0.44 magnum projectile incoming at a velocity of about 1,400 to 1,450 feet per second; and disposing said final composite fabric between said body in need of protection and a threat contemplated by said NIJ IIIA specification that would otherwise be adapted to penetrate said body.

17. A method as claimed in claim 16, further comprising forming an accumulation of a plurality of said sub-assemblies sufficient in number to resist penetration therethrough of said threat.

18. A method as claimed in claim 16 further comprising accumulating a plurality of said sub-assemblies and combining said accumulation with at least one resin bonded non-woven fabric comprising anti-ballistic filaments to produce a composite anti-ballistic fabric, wherein the number of said sub-assemblies and the number of said resin bonded non-woven fabrics is sufficient to resist the penetration therethrough of said threat.

19. A method as claimed in claim 16 further comprising disposing at least one additional layer of uncured substantially permanently flexible resin on at least about 75% of an unbonded major surface of at least one of said first and second woven fabrics; disposing at least one additional woven fabric comprising anti-ballistic filaments on said uncured additional resin layer; and curing said additional flexible bonding agent under such conditions that: the cured bonding agent adheres said additional woven fabric to said sub-assembly over at least about 75% of their juxtaposed major surfaces, said cured bonding agent does not exude through the interstices of either of said woven fabrics, and maintains its substantial flexibility after curing; whereby forming a composite sub-assembly of said two woven fabrics and said flexible bonding resin.

20. A method as claimed in claim 16 further comprising combining said sub-assembly with non anti-ballistic fabric and converting said combination into a garment.

21. A method as claimed in claim 17 further comprising combining said accumulation with non anti-ballistic fabric and converting said combination into a garment.

22. A method as claimed in claim 18 further comprising combining said composite anti-ballistic fabric with non-anti-ballistic fabric and converting said combination into a garment.

23. In a composite anti-ballistic fabric comprising a plurality of plies of woven fabrics comprising anti-ballistic fibers; the improvement that comprises said fabric comprising a plurality of sub-assemblies each consisting essentially of at least two woven fabric plies that are bonded together solely by a substantially flexible resin that covers at least 75% of the juxtaposed surfaces of said at least two plies, wherein said composite fabric has an areal density of not greater than about 0.95 pound per square foot, and wherein said composite fabric has the ability to pass the NIJ IIIA specification in response to a 0.44 magnum projectile incoming at a velocity of about 1,400 to 1,450 feet per second.

24. The composite fabric claimed in claim 23 wherein the fibers of said woven fabric plies have a tensile modulus of at least about 160 grams per denier and a tenacity of at least about 7 grams per denier.

25. The composite fabric claimed in claim 23 wherein the fibers of said woven fabric plies have a tensile modulus of at least about 300 grams per denier and a tenacity of at least about 15 grams per denier.

26. The composite fabric claimed in claim 23 wherein said flexible resin has a flex modulus of at least about 6,000 psi and has a rubbery consistency.

27. The composite fabric claimed in claim 23 wherein said flexible resin comprises block copolymers of conjugated dienes; vinyl aromatics; polybutadiene; polyisoprene; natural rubber; ethylene-propylene copolymers; ethylene-propylene-diene terpolymers; polysulfide polymers; polyuretheane elastomers, chlorosulfonated polyethylene; polychloroprene; plasticized polyvinyl chloride, butadiene-acrylonitrile elastomers; acrylonitrile-butadiene-styrene elastomers; isobutylene-isoprene copolymers; plasticized polyacrylates; polyesters, polyethers; fluorocarbon elastomers; and silicone elastomers.

28. The composite fabric claimed in claim 23 wherein said flexible resin comprises styrene-butadiene-styrene block copolymer.

29. The composite fabric claimed in claim 23 additionally comprising at least one ply of a resin bonded non-woven fabric.

30. The composite fabric claimed in claim 23 additionally comprising at least one ply of a woven fabric that is not bonded to another woven fabric.

* * * * *